US009197014B2

(12) United States Patent
Wu

(10) Patent No.: US 9,197,014 B2
(45) Date of Patent: Nov. 24, 2015

(54) ELECTRICAL CONNECTOR MODULE

(71) Applicants: AMBIT MICROSYSTEMS (SHANGHAI) LTD., Shanghai (CN); HON HAI PRECISION INDUSTRY CO., LTD., New Taipei (TW)

(72) Inventor: Bao-Kun Wu, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 9 days.

(21) Appl. No.: 14/016,402

(22) Filed: Sep. 3, 2013

(65) Prior Publication Data

US 2014/0315415 A1 Oct. 23, 2014

(30) Foreign Application Priority Data

Apr. 22, 2013 (CN) ..... 2013 2 0204435 U

(51) Int. Cl.
*H01R 13/627* (2006.01)
*H01R 13/635* (2006.01)

(52) U.S. Cl.
CPC ..... *H01R 13/6275* (2013.01); *H01R 13/635* (2013.01)

(58) Field of Classification Search
CPC ..... H01R 13/6273; H01R 13/6275; H01R 13/62938; H01R 13/62; H01R 13/629; H01R 13/62922; H01R 13/62977; H01R 13/6274; H01R 13/62905; H01R 13/6335; H01R 12/722; H01R 12/7005; H01R 12/7029; H01R 12/7017; H01R 12/7011
USPC ..... 439/270, 298, 594, 352, 903, 372, 157, 439/160
See application file for complete search history.

(56) References Cited

U.S. PATENT DOCUMENTS 4,761,141 A * 8/1988 Hawk et al. ..... 439/153
5,730,611 A * 3/1998 Cheng et al. ..... 439/160

* cited by examiner

*Primary Examiner* — Amy Cohen Johnson
*Assistant Examiner* — Oscar C Jimenez
(74) *Attorney, Agent, or Firm* — Novak Druce Connolly Bove + Quigg LLP

(57) ABSTRACT

An electrical connector module, includes a first connecting part and a second connecting part. The first connecting part includes a main body and a pair of protrusion portions. The second connecting part includes a base seat, a receiving portion on the base body; and a pair of latching assemblies. The latching assembly includes a pair of first blocking members, a pair of second blocking members and a latching member. The latching member is located between the pair of first blocking members and the pair of second blocking members. The latching member includes a base body, a latching portion protruding from the base body, and a pair of cam portions on the base body, each cam portion is rotatably retained between one first blocking member and one second blocking member.

17 Claims, 4 Drawing Sheets

ELECTRICAL CONNECTOR MODULE

BACKGROUND

1. Technical Field

The present disclosure relates to an electrical connector module, and more particularly, to an electrical connector module having cam portions.

2. Description of Related Art

Electrical connector module may include a male connector and a female connector assembled to the male connector for conducting current. The male connector includes a pair of latching tabs and several terminals electrically connected to a disconnect cable. The female connector includes a pair of hooks, and is electrically connected to another disconnect cable. The male connector is connected to the female connector to connect the two disconnect cables via the several terminals. When assembling the female connector to the male connector, the female connector is aligned to the male connector and is inserted into the male connector. Then the pair of latching tabs latches with the pair of hooks. When disassembling the electrical connector module, the female connector is pressed inward to the male connector to enable the pair of hooks to be bent outward, thereby detaching from the pair of hooks. Then, the female connector is pulled out of the male connector, and separated from the male connector. However, a relative large amount of force is needed to press the female connector.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
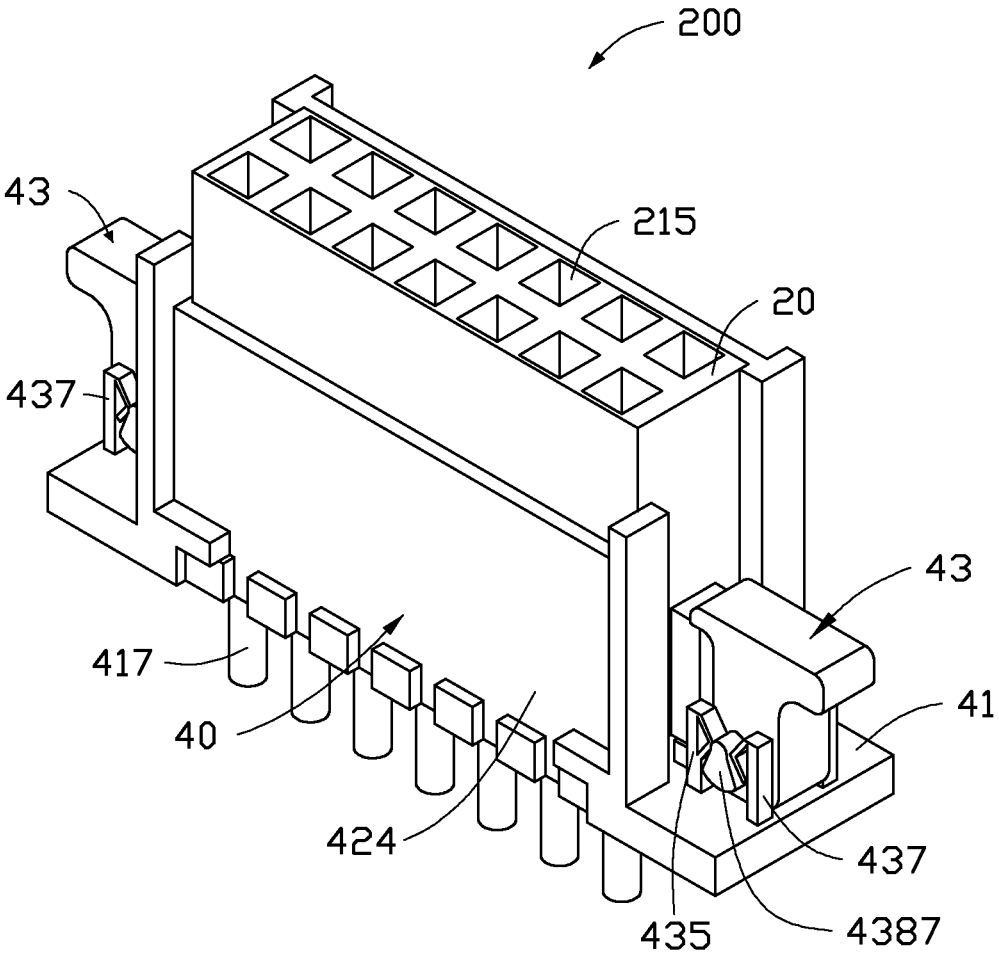
FIG. 1 is an isometric view of an embodiment of an electrical connector module.

FIG. 1 shows an electrical connector module 200 including a first connecting part 20 and a second connecting part 40. The first connecting part 20 is partially received in the second connecting part 40, and latches with the second connecting part 40.

Figure 2:
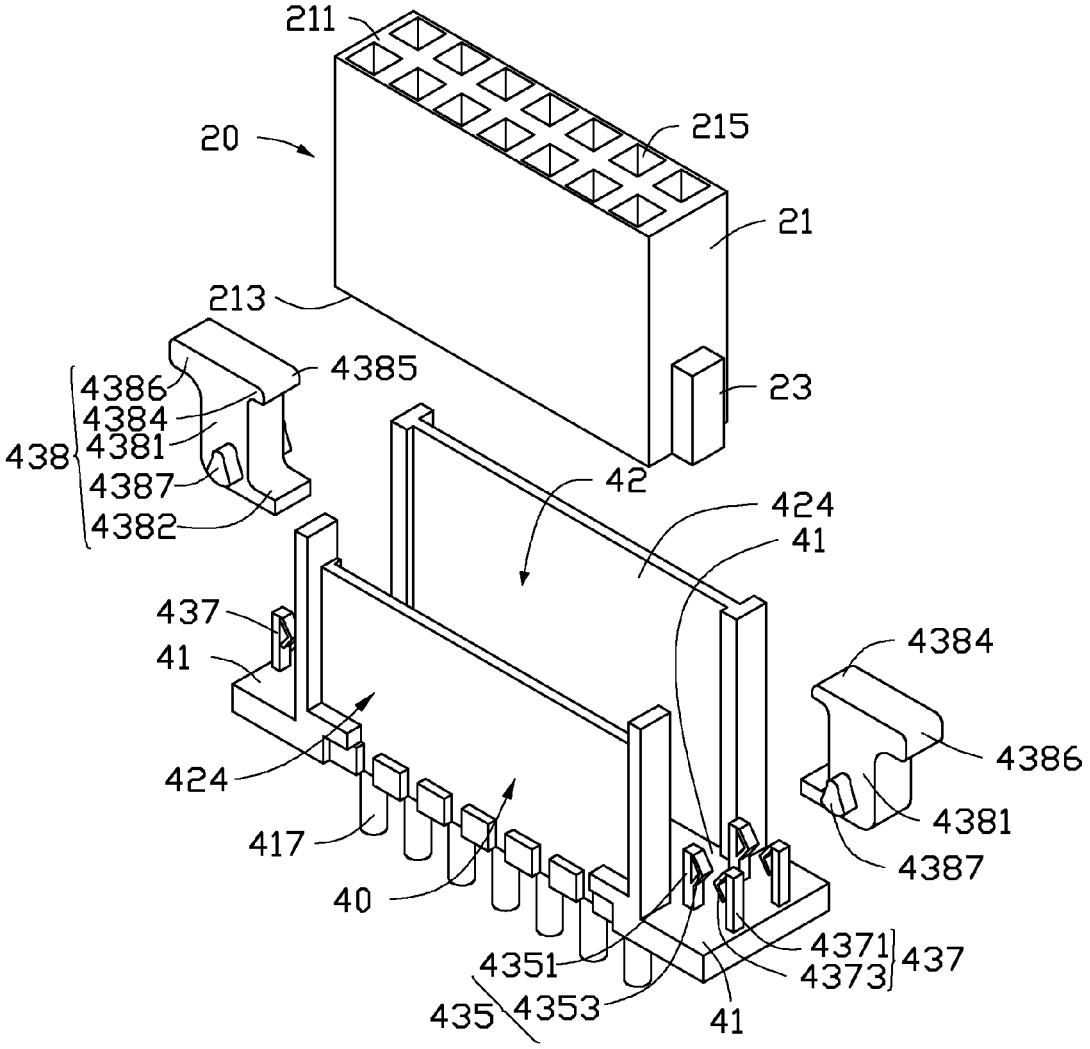
FIG. 2 is an exploded, isometric view of the electrical connector module of FIG. 1.
Figure 3:
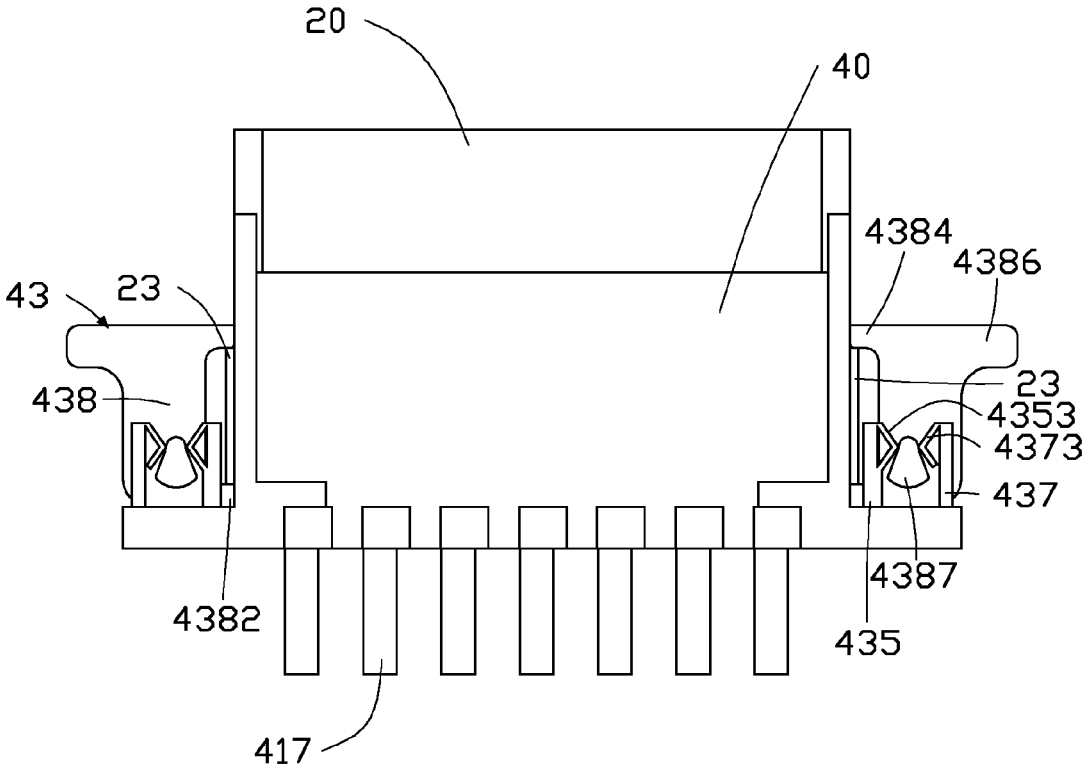
FIG. 3 is a side view of the electrical connector module of FIG. 1.
Figure 4:
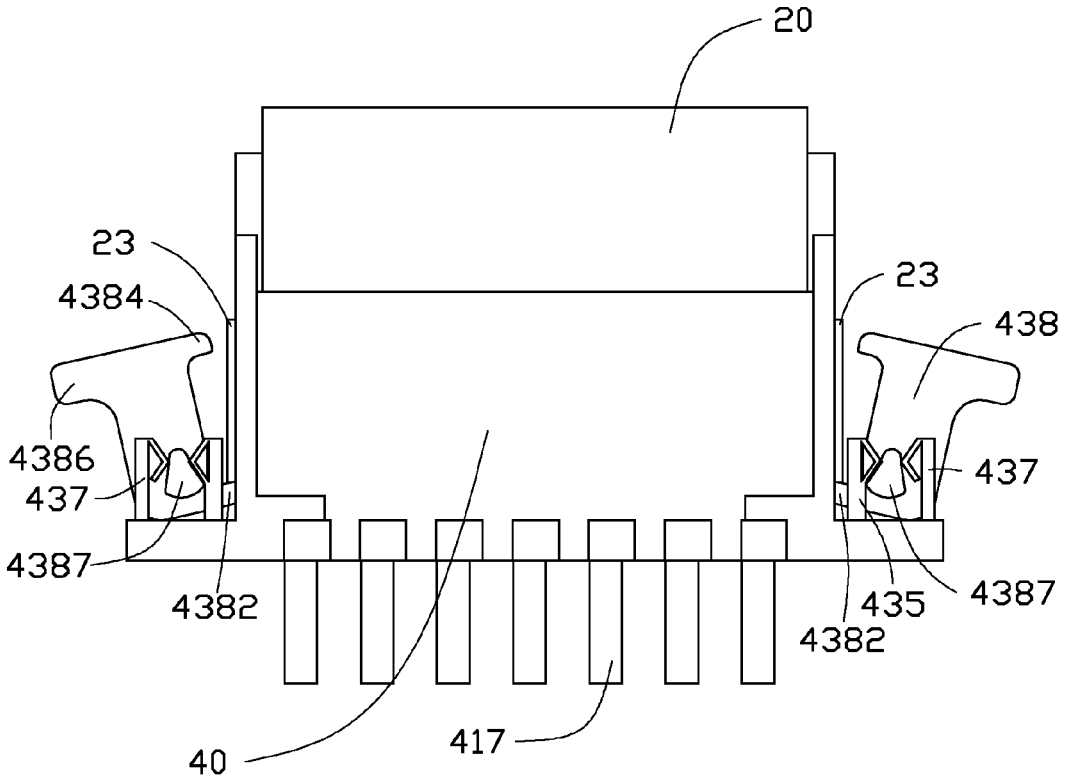
FIG. 4 is similar to FIG. 3, but shown in a detaching state.

Also referring to FIGS. 2 and 3, the first connecting part 20 includes a main body 21, and a pair of protrusion portions 23 protruding from opposite sides of the main body 21. The main body 21 is substantially a rectangular block. The main body 21 includes a top surface 211 and a bottom surface 213, and defines a plurality of receiving grooves 215. The plurality of receiving grooves 215 is depressed and extended toward the bottom surface 213. Each receiving groove 215 receives a first terminal (not shown) to connect with a first cable (not shown). The pair of protrusion portions 23 is located adjacent to the bottom surface 213.

The second connecting part 40 includes a base seat 41, a receiving portion 42 on the base seat 41 and a pair of latching assemblies 43 at opposite ends of the receiving portion 42. The base seat 41 is in a plate shape, the receiving portion 42 is located at a middle region of the base seat 41. The receiving portion 42 includes a pair of side walls 424 configured and formed on a top of the base seat 41 and a plurality of sleeving tubes 417 on a bottom of the base seat 41. The pair of side walls 424 perpendicularly protrudes from opposite edges of the base seat 41, and is spaced from each other. The plurality of the sleeving tubes 417 perpendicularly extends from the base seat 41 away from the first connecting part 20. Each sleeving tube 417 receives a second terminal (not shown) to connect with a second cable (not shown). The plurality of sleeving tubes 417 is respectively connected to the plurality of receiving grooves 215 to enable the first terminals to be electrically connected to the second terminals of the first connecting part 20.

The pair of latching assemblies 43 is located at opposite ends of the base seat 41 and partially received in the receiving portion 42. The pair of latching assemblies 43 is employed to latch with the pair of protrusion portions 23. Each latching assembly 43 includes a pair of first blocking members 435, a pair of second blocking members 437, and a latching member 438. The pair of first blocking members 435 is located adjacent to an end of the receiving portion 42. The pair of second blocking members 437 is located adjacent to the pair of first blocking members 435 away from the receiving portion 42. The latching member 438 is rotatably received between the pair of first blocking members 435 and the pair of second blocking members 437. The latching member 438 is partially received in the receiving portion 42.

The pair of first blocking members 435 are spaced from each other. Each first blocking member 435 includes a fixing portion 4351 and a blocking portion 4353 formed on the fixing portion 4351. The fixing portion 4351 is in a post shape and perpendicularly protrudes from the base seat 41. The blocking portion 4353 is elastically configured and substantially in a "V" shape. The blocking portion 4353 is located on an end of the fixing portion 4351 away from the base seat 41 and faces the corresponding second blocking member 437. A sharp or pointed end (not labeled) of the blocking portion 4353 faces the second blocking member 437. The first blocking member 435 may be integrally formed on the base seat 41.

The pair of second blocking members 437 are spaced from each other, and positioned at an end of the base seat 41 away from the receiving portion 42. Each second blocking member 437 has a structure the same as that of the first blocking member 435. The second blocking member 437 includes a fixing portion 4371 and a blocking portion 4373. The blocking portion 4373 is spaced from the corresponding blocking portion 4353 of the first blocking member 435 by a predetermined distance or gap.

The latching member 438 is mounted on the base seat 41 and partially received in the receiving portion 42. The latching member 438 includes a base body 4381, a supporting portion 4382, a latching portion 4384, a handle 4386, and a pair of cam portions 4387. The base body 4381 is in rectangular block shape, and is received between the pair of first blocking members 435 and the pair of second blocking members 437. The supporting portion 4382 protrudes from a side of an end of the base body 4381. The supporting portion 4382 extends toward the receiving portion 42 and is partially received in the receiving portion 42. The supporting portion 4382 supports a portion of the main body 21 which is adjacent to the bottom surface 213 of the man body 21. The latching portion 4384 and the handle 4386 protrude from opposite sides of an end of the base body 4381 opposite to the support portion 4382. The latching portion 4384 extends toward the receiving portion 42 and defines a chamfering surface 4385 thereon away from the base body 4381. The handle 4386 extends away from the receiving portion 42. The pair of cam portions 4387 protrudes from opposite sides of the base body 4381. The pair of cam portions 4387 is located adjacent to the supporting portion 4382 and extends along an axis perpendicular to an extending direction of the handle 4386. Each cam portion 4387 is located between one first blocking member 435 and one second blocking member 437. Each cam portion 4387 has a width thereof increasing along a direction toward the supporting portion 4382. The cam portion 4387 resists a bottom of the blocking portions 4353 and a bottom of the blocking portion 4373 by opposite sides thereof.

When in use, the first connecting part 20 is inserted into the receiving portion 42 of the second connecting part 40. The pair of protrusion portions 23 resists the chamfering surfaces 4385 of the pair of latching members 438 to rotate the pair of latching members 438, thereby pushing the two latching portions 4384 away from each other. The cam portion 4387 rotates relative to the first blocking member 435. Then the first connecting part 20 enters between the pair of latching members 438. At the time, the main body 21 of the first connecting part 20 resists on the supporting portions 4382, and the supporting portions 4382 are tilted at an angle. The first connecting part 20 is inserted into the receiving portion 42, the main body 21 pushes the supporting portions 4382 downward, thereby rotating the pair of latching members 438 to enable the pair of latching portions 4384 to move toward each other. The cam portion 4387 rotates relative to the second blocking member 437, and the latching portions 4384 latch with the pair of protrusion portions 23. Therefore, the first connecting part 20 is assembled to the second connecting part 40

When disassembly the first connecting part 20 from the second connecting part 40, the pair of handles 4386 are pulled away from each other by an operator. The pair of latching members 438 rotates away from each other. The cam portions 4387 resist the blocking portions 4373 to deform, then the latching portions 4384 detach from the pair of protrusion portions 23 to unlock the first connecting part 20 from the pair of latching members 438. Simultaneously, the pair of supporting portions 4382 resists the pair of protrusion portions 23 in an upward direction. When the first connecting part 20 detaches from the second connecting part 40, the blocking portions 4353, 4373 rebound and resist the cam portions 4387, thereby rotating the pair of latching members 438 to an original state.

The number of the protrusion portions 23 is not limited to two, and it may be one or more than two, the number of the latching assemblies 43 should be changed accordingly. The number of the first blocking members 435 is not limited to two, it may be one or more than two, the number of the cam portions 4387 of one latching member 438, and the number of the second blocking members 437 may be changed accordingly.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. An electrical connector module, comprising:

a first connecting part comprising:

a main body; and at least one protrusion portion protruding from a side of the main body; and a second connecting part comprising:

a base seat;

a receiving portion on the base seat; and at least one latching assembly located adjacent to an end of the receiving portion, the at least one latching assembly comprising:

at least one first blocking member on the base seat, at least one second blocking member on the base seat and spaced from the at least one first blocking member; and a latching member located between the at least one first blocking member and the at least one second blocking member, wherein the at least one first blocking member and the at least one second blocking member are elastically configured, the latching member comprises a base body, a latching portion protruding from the base body toward the receiving portion, and a cam portion on the base body, the cam portion is rotatably retained between the at least one first blocking member and the at least one second blocking member, when the first connecting part is inserted into the receiving portion, the at least one protrusion portion latches with the latching portion, when the latching member is rotated, the cam portion resists the at least one of the first blocking member and the at least one second blocking member to make the at least one of the first blocking member and the at least one second blocking member be deformed, and the latching portion disengages from the at least one protrusion portion to release the first connecting part;

wherein when the first connecting part is detached from the second connecting part and the latching member is pulled away, the at least one first blocking member and the at least one second blocking member rebound and apply a force to the cam portion so as to make the latching member return to an original state.

2. The electrical connector module of claim 1, wherein the latching member further comprises a supporting portion located at an end of the base body away from the latching portion, the supporting portion is partially received in the receiving portion, when the latching portion latches with the at least one protrusion portion, the supporting portion supports the main body of the first connecting part.

3. The electrical connector module of claim 2, wherein the latching member further comprises a handle, the handle protruding out of the base body opposite to the latching portion.

4. The electrical connector module of claim 1, wherein the latching portion protrudes from a side of an end of the base body, the cam portion is formed on a side of the base body, when the latching portion engages with the at least one protrusion portion, the at least one protrusion portion is retained between the base seat and the latching portion.

5. The electrical connector module of claim 1, wherein the receiving portion comprises a pair of side walls on the base seat to clamp the first connecting part, the pair of side walls perpendicularly protrudes from opposite edges of the base seat, and is spaced from each other, the at least one first blocking member and the at least one second blocking member are located adjacent to an end of the pair of side walls.

6. The electrical connector module of claim 5, wherein the at least one first blocking member is adjacent to the pair of side walls, the at least one second blocking member is adjacent to the at least one first blocking member and away from the pair of side walls, and the at least one first blocking member and the at least one second blocking member are lower than the pair of side walls.

7. The electrical connector module of claim 6, wherein the at least one second blocking member comprises a fixing portion and a blocking portion on the fixing portion, the fixing portion perpendicularly protrudes from the base seat, the blocking portion is located at an end of the fixing portion away from the base seat and faces the at least one first blocking member, the blocking portion is elastically configured and substantially in a "V" shape, and is capable of being deformed away from the at least one first blocking member.

8. The electrical connector module of claim 7, wherein the at least on protrusion portion is two protrusion portions protrude from opposite sides of the main body, the at least one latching assembly are two latching assemblies symmetrically mounted on opposite ends of the base seat, the two latching assemblies detachably engage with the two protrusions portions, respectively.

9. An electrical connector module, comprising:
- a first connecting part comprising:
  - a main body; and
  - a pair of protrusion portions protruding from opposite sides of the main body; and
- a second connecting part comprising:
  - a base seat;
  - a receiving portion on the base seat; and
  - a pair of latching assemblies located adjacent to opposite ends of the receiving portion, each latching assembly comprising:
    - at least one first blocking member on the base seat,
    - at least one second blocking member on the base seat; and
    - a latching member located between the at least one first blocking member and the at least one second blocking member, wherein at least one of the at least one first blocking member and the at least one second blocking member is elastically configured, the latching member comprises a base body, a latching portion protruding from the base body toward the receiving portion, and a cam portion on the base body, the cam portion is rotatably retained between the at least one first blocking member and the at least one second blocking member, when the first connecting part is inserted into the receiving portion, the pair of protrusion portions respectively latches with the pair of latching portions of the pair of latching assemblies, when the latching member is rotated, the cam portion is driven to resist the at least one of the first blocking member or the second blocking member to make the at least one of the first blocking member and the at least one second blocking member be deformed, and the pair of latching portions disengages from the pair of protrusion portions to release the first connecting part;
  - wherein when the first connecting part is detached from the second connecting part and the latching member is pulled away, the at least one first blocking member and the at least one second blocking member rebound and apply a force to the cam portion so as to make the latching member return to an original state.

10. The electrical connector module of claim 9, wherein the latching member further comprises a supporting portion located at an end of the base body away from the latching portion, the supporting portion is partially received in the receiving portion, when the latching portion latches with the protrusion portion, the supporting portion supports the main body of the first connecting part.

11. The electrical connector module of claim 9, wherein the latching member further comprises a handle, the handle protruding out of the base body opposite to the latching portion, the at least one first blocking member is adjacent to the pair of side walls, the at least one second blocking member is adjacent to the at least one first blocking member and away from the pair of side walls.

12. The electrical connector module of claim 9, wherein the latching portion protrudes from a side of an end of the base body, the cam portion is formed on a side of the base body, when the latching portion engages with the protrusion portion, the protrusion portion is retained between the base seat and the latching portion.

13. The electrical connector module of claim 9, wherein the receiving portion comprises a pair of side walls on the base seat to clamp the first connecting part, the pair of side walls perpendicularly protrudes from opposite edges of the base seat and is spaced from each other, the at least one first blocking member and the at least one second blocking member are located adjacent to an end of the pair of side walls, and the at least one first blocking member and the at least one second blocking member are lower than the pair of side walls.

14. The electrical connector module of claim 13, wherein the at least one second blocking member comprises a fixing portion and a blocking portion on the fixing portion, the fixing portion perpendicularly protrudes from the base seat, the blocking portion is located at an end of the fixing portion away from the base seat and faces the at least one first blocking member, the blocking portion is elastically configured and substantially in a "V" shape, and is capable of being deformed away from the at least one first blocking member.

15. The electrical connector module of claim 9, wherein each latching assembly comprises a pair of first blocking members and a pair of second blocking members, the pair of first blocking member is adjacent to the receiving portion, the pair of second blocking member is adjacent to the first blocking member and away from the receiving portion, the base body is received between the pair of first blocking members and the pair of second blocking members, the latching member comprises a pair of cam portions protruding from opposite sides thereof, each cam portion is retained between one first blocking member and one second blocking member.

16. An electronic connecting module, comprising:
- a connecting part, being engaged with another connecting part, the another connecting part comprising a protrusion portion; the connecting part comprising:
  - a base seat;
  - a receiving portion on the base seat; and
  - at least one latching assembly located adjacent to an end of the receiving portion, the at least one latching assembly comprising:
    - at least one first blocking member on the base seat,
    - at least one second blocking member on the base seat and spaced from the at least one first blocking member; and
    - a latching member located between the at least one first blocking member and the at least one second blocking member, wherein the at least one first blocking member and the at least one second blocking member are elastically configured, the latching member comprising a base body and a cam portion rotatably retained between the at least one first blocking member and the at least one second blocking member, when the latching member is rotated, the cam portion resists the at least one of the first blocking member and the at least one second blocking member to make the at least one of the first blocking member and the at least one second blocking member be deformed, and the another connecting part disengages from the connecting part;

wherein when the another connecting part is detached from the connecting part and the latching member is pulled away, the at least one first blocking member and the at least one second blocking member rebound and apply a force to the cam portion so as to make the latching member return to an original state.

17. The electronic connecting module of claim 16, wherein the receiving portion comprises a pair of side walls on the base seat, the pair of side walls perpendicularly protrudes from opposite edges of the base seat, and is spaced from each other, so as to make the another connecting part be located between the pair of side walls, the at least one first blocking member and the at least one second blocking member are located adjacent to an end of the pair of side walls, and the at least one first blocking member and the at least one second blocking member are lower than the pair of side walls.

* * * * *